US007292210B2

(12) United States Patent
Sun

(10) Patent No.: US 7,292,210 B2
(45) Date of Patent: Nov. 6, 2007

(54) CIRCUIT FOR DRIVING FLAT PANEL DISPLAY

(75) Inventor: Wein-Town Sun, Kaohsiung (TW)

(73) Assignee: Au Optronics Corporation, Hsinchu (TW)

( * ) Notice: Subject to any disclaimer, the term of this patent is extended or adjusted under 35 U.S.C. 154(b) by 694 days.

(21) Appl. No.: 10/820,837

(22) Filed: Apr. 7, 2004

(65) Prior Publication Data

US 2005/0122290 A1 Jun. 9, 2005

(30) Foreign Application Priority Data

Dec. 3, 2003 (TW) ..... 92133975

(51) Int. Cl.
*G09G 3/32* (2006.01)
*G09G 3/36* (2006.01)

(52) U.S. Cl. ..... 345/82; 345/76; 345/44; 345/46; 345/83; 315/169.3

(58) Field of Classification Search ..... 345/39, 345/44–66, 76–83; 315/169.3
See application file for complete search history.

(56) References Cited

U.S. PATENT DOCUMENTS 6,501,448 B1 * 12/2002 Komiya et al. ..... 345/80
6,933,756 B2 * 8/2005 Miyazawa ..... 327/112
2003/0214469 A1 * 11/2003 Kageyama et al. ..... 345/82

* cited by examiner

*Primary Examiner*—Amare Mengistu
*Assistant Examiner*—Jennifer Zubajlo
(74) *Attorney, Agent, or Firm*—J.C. Patents

(57) ABSTRACT

The present invention provides a circuit for driving a flat panel display, including a storage capacitor, a transmission gate and a current-limiting transistor. A first terminal of the storage capacitor is coupled to a system voltage, and a second terminal of the storage capacitor is at storage voltage. A first input/output terminal of the transmission gate is coupled to the storage voltage, and the second input/output terminal of the transmission gate is coupled to the data current source. A first gate terminal of the transmission gate is coupled to the first signal; a second gate terminal of the transmission gate is coupled to the second signal. A gate terminal of the current-limiting transistor is coupled to the storage voltage, wherein a first source/drain terminal is coupled to the system voltage, and a second source/drain terminal provides current for driving the flat panel display.

11 Claims, 6 Drawing Sheets

CIRCUIT FOR DRIVING FLAT PANEL DISPLAY

CROSS-REFERENCE TO RELATED APPLICATION

This application claims the priority benefit of Taiwan application serial no. 92133975, filed on Dec. 3, 2003.

BACKGROUND OF THE INVENTION

1. Field of the Invention

This invention generally relates to a circuit of a flat panel display, and more particularly to a circuit for driving a flat panel display.

2. Description of Related Art

In the present 21$^{st}$ century information era, interface between users and electronic products, namely, display panels, play significant role in our everyday. Presently, traditional cathode ray tube display (CRT display), is being gradually replaced by a flat display because of its disadvantages of occupying larger space, heavier, high radiation, high power consumption compared to the flat panel displays. Accordingly, because the flat panel display is flatter and thinner occupying less space, lighter, consume less power, and provides high quality display, has become the main stream of the next generation display products. Currently, a FPD is dominated by Liquid Crystal Display (LCD). However, the LCD has several shortcomings, namely, narrow view angle and slow response speed or slow reaction. Accordingly, residual images occur when playing animation pictures. On the other hand, because the liquid crystal itself cannot illuminate and therefore a backlight module is required for illuminating the LCD display. And further, because the liquid crystals of LCD being colorless, color filters are required. Accordingly, the inclusion of backlight module and the color filters into the LCD display will increase the weight the thickness and the power consumption thereof.

Organic Luminescence Emitting Diode was disclosed in 1987 and was applied in a FPD so that the need of a backlight module can be eliminated and therefore a thinner and lighter FPD can be achieved. An Organic Luminescence Emitting diode Display, also known as OLED comprises a plurality of organic luminous elements set between two electrodes. When a current is applied to these organic luminous elements via the electrodes, light is emitted. Since the luminance or the brightness of the organic luminescence emitting diode is proportional to applied current, and therefore any current variation will directly affect the uniformity of OLED illumination. Because a general voltage driven pixel cannot compensate illumination non-uniformity among TFT pixels, and therefore it is commonly believed that the current driven pixel provides better illumination uniformity.

FIG. 1A is a circuit diagram illustrating a conventional circuit for driving a flat panel display. FIG. 1B is a timing diagram illustrating voltage or current the signals of FIG. 1A. As shown in FIG. 1A, a current-driven pixel generally comprises a storage capacitor 131, which is adapted data to store a voltage. The storage capacitor 131 accumulates the voltage during scanning signal Scan. That is, when the scanning signal Scan switches from a high voltage level to a low voltage level, the transistors 101 and 103 are turned on, the transistor 102 is turned off, a voltage $V_a$ is stored into the storage capacitor 131 as a data signal Data. The voltage $V_a$ is the voltage at node a in FIG. 1A, which determines the resistance of the transistor 105. When the scanning signal Scan is cut off (i.e. switching from low to high voltage level), the transistors 101 and 103 are turned off, and the transistor 102 is turned on, the transistor 105 controls the current density flowing through the OLED diode according to the stored voltage $V_a$. In other words, the stored voltage $V_a$ in the storage capacitor 131 indirectly determines the luminance intensity of OLED diode.

In practical application, when the scanning signal Scan is cut off, the original charge stored at node a is affected due to feed-through effect in a manner that the stored voltage $V_a$ is changed as well. When the stored voltage $V_a$ is changed, the current density flowing through the transistor 105 and the organic luminescence emitting diode (OLED) is correspondingly changed. Thus grayscale distortion problem would occur since pixels are of low uniformity. Yet if the capacitance of the storage capacitor Cs is enlarged for intervening feed-through effect, the pixel-opening rate is reduced, large chip area is consumed and the response speed or the reaction speed is lowered. Accordingly, this approach is not desirable.

SUMMARY OF THE INVENTION

Accordingly, the present invention provides a circuit for driving flat panel display to improve the response speed or the reaction speed.

According to an embodiment of the present invention, two complementary transistors are adapted for data sampling of storage capacitor in order to reduce feed-through effect to improve current quality. On the other hand, the capacitance of the storage capacitor is reduced so that the flat panel display can be operated at a higher frequency.

According to another embodiment of the present invention, a circuit for current-driven flat panel display, and a circuit of an OLED display pixel are provided.

The present invention provides a circuit for driving a current-driven flat panel display. The circuit receives a current data, a first signal and a second signal, and outputs a current driving the OLED display via current output terminal according to the current data. The circuit comprises a storage capacitor, a transmission gate and a current-limiting transistor. The storage capacitor has a first terminal coupled to system voltage and a second terminal of the storage capacitor is coupled to a storage voltage. The transmission gate includes a first N-type transistor and a first P-type transistor. A first source/drain terminal of the first N-type transistor is coupled to a first source/drain terminal of the first P-type transistor to serve as the first input/output terminal of the transmission gate. A second source/drain terminal of the first N-type transistor is coupled to a second source/drain terminal of the P-type transistor to serve as the second input/output terminal of the transmission gate. A gate of the first N-type transistor serves as a first gate terminal of the transmission gate, and a gate of the second N-type transistor serves as a second gate terminal of the transmission gate. The first input/output terminal of the transmission gate is coupled to the storage capacitor, and the second input/output terminal of the transmission gate is coupled to the data current source. The first gate terminal of the transmission gate is coupled to the first signal, and the second gate terminal of the transmission gate is coupled to the second signal. A gate of the current limiting transistor is coupled to the storage voltage, wherein the first source/drain terminal is coupled to the system voltage, the second source/drain terminal is coupled to the current output terminal. The current limiting transistor is for determining current density flowing through the transistor according to the storage voltage.

The present invention provides circuit for driving a current-driven flat panel display. The circuit receives a current data, a first signal and a second signal, and outputs a current to the OLED display via driving current output terminal according to a storage voltage. The circuit comprises a storage capacitor, a transmission gate, a current limiting transistor, a second P-type transistor, a third P-type transistor and a fourth P-type transistor. The storage capacitor has a first terminal coupled to the system voltage and a second terminal coupled to the storage voltage. The transmission gate comprises an N-type transistor and a first P-type transistor. A first source/drain of the N-type transistor is coupled to a first source/drain of the first P-type transistor to serve as a first input/output terminal of the transmission gate. A second source/drain of the first P-type transistor is coupled to the second source/drain to serve as a second input/output terminal of the transmission gate. A gate of the N-type transistor serves as a first gate of the transmission gate, and a gate of the first P-type transistor serves as a second gate of the transmission gate. The first input/output terminal of the transmission gate is coupled to the storage voltage, the first gate of the transmission gate is coupled to the first signal, and the second gate of the transmission gate is coupled to the second signal.

A gate of the current limiting transistor is coupled to the storage voltage. A source/drain terminal of the current limiting transistor is coupled to the system voltage. The current limiting transistor is for limiting current density flowing through the transistor according to the storage voltage. A first source/drain terminal of the second P-type transistor is coupled to the second input/output terminal of the transmission gate as well as to a second source/drain of the current-limiting transistor. A second source/drain terminal of the second P-type transistor is coupled to the current output terminal. A first source/drain terminal of the third P-type transistor is coupled to the storage voltage, a second source/drain and a gate of the third P-type transistor are both coupled to a gate of the third P-type transistor. A source/drain terminal of the fourth P-type transistor is coupled to the gate of the third P-type transistor, a second source/drain of the fourth P-type transistor is coupled to the data current source, and a gate of the fourth P-type transistor is coupled to the second signal.

Because the current density flowing through the transistor is controlled by the transmission gate comprised of two complementary transistors, and therefore the feed-through effect is avoided and also a better grayscale performance is achieved via data sampling of the storage capacitor by the transmission gate. Meanwhile, storage capacitor is reduced to achieve higher operation frequency of the pixels. Since storage capacitor is reduced, higher resolution of the current-driven flat panel display is achieved.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE PREFERRED EMBODIMENTS

This present invention applies to various current-driven flat panel displays. In favor of description for this present invention, an organic luminescence emitting display (OLED) is exemplary. Thus the scope of the present invention is not limited with the following description of the preferred embodiments.

Figure 1A:
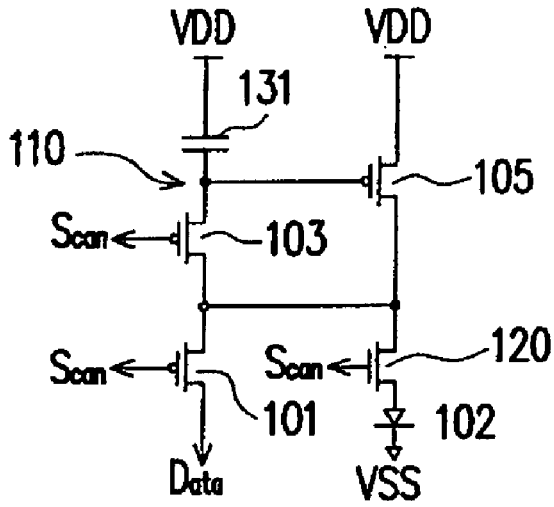
FIG. 1A (PRIOR ART)
FIG. 1A is a circuit diagram illustrating a conventional circuit for driving a current-driven flat panel display.
Figure 1B:
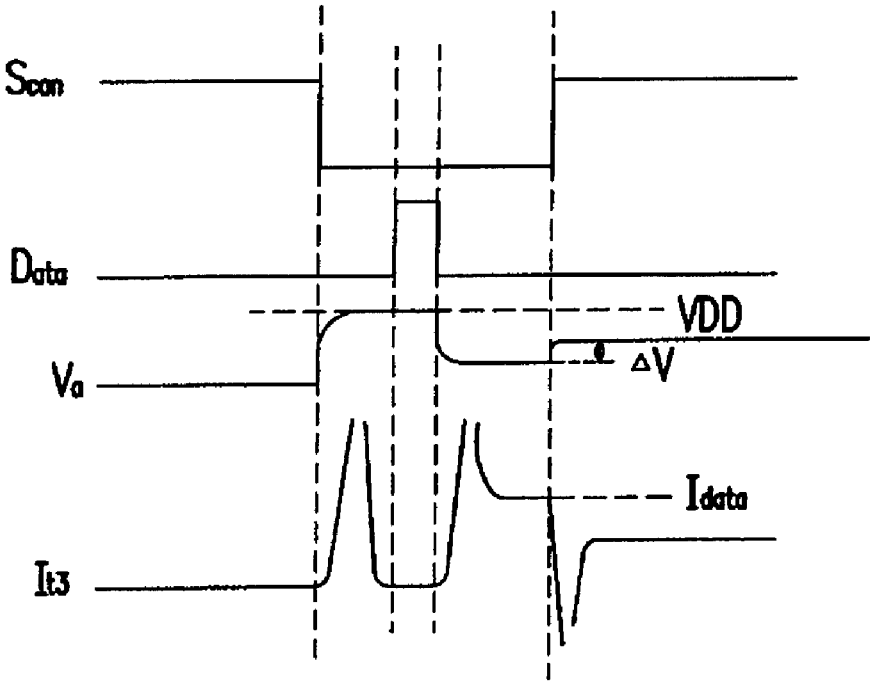
FIG. 1B (PRIOR ART)
FIG. 1B is a timing diagram illustrating voltage or current signals of the current-driven flat panel display shown in FIG. 1A.
Figure 2A:
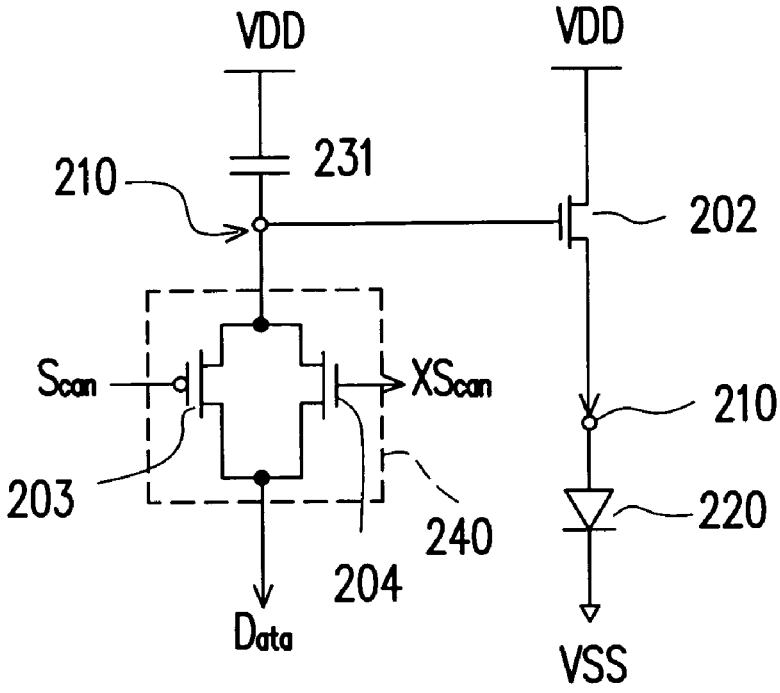
FIG. 2A is a block diagram illustrating a circuit for driving a current-driven flat panel display according to one embodiment of the present invention.

Referring to FIG. 2A, a block diagram of a circuit for driving a current-driven flat panel display according to one preferred embodiment of the present invention is shown. In FIG. 2A, circuit of one of the pixels of the OLED display is depicted, which illuminates upon receiving the current outputted from current output terminal 210. In this preferred embodiment, the OLED in the figure is an organic luminescence emitting diode, for example. In this embodiment of the present invention, two complementary transistors 203 and 204 are used in order to maintain node a at a voltage $V_a$. The two transistors 203 and 204 are complementary transistors, meaning one being N-type transistor 204 and the other being P-type transistor 203. Two complementary transistors are required to satisfy the two conditions represented by the following equations $\mu_N(W_N/L_N)=\mu_P(W_P/L_P)$ and $W_N \times L_N = W_P \times L_P$, where μ denotes carrier mobility, W denotes channel width of the transistors, and L denotes channel length of the transistors. The first condition renders the current flowing through the P-type transistor 203 and the N-type transistor 204 similar to that flowing through the transmission gate 240, and the second condition reduces or eliminates feed-through effect of the storing voltage $V_a$ by switching off of the scanning signal Scan. Those skilled in the art will appreciate that it is not practical to make the P-type transistor 203 and the N-type transistor 204 completely complementary, however it should be understood that higher the complementation between the P-type transistor 203 and the N-type transistor 204 is, the better the performance of reducing or eliminating the feed-through effect is. Accordingly, even when the foregoing transistors 203 and 204 are not completely complementary; it is still within the scope of the present invention.

Assuming that the voltage at node a in FIG. 2A is the storing voltage $V_a$. When the scanning signal Scan is in on state (low level voltage in this preferred embodiment, for example), the P-type transistor 203 is turned on. A complementary-scanning signal XScan is inverse of the scanning signal Scan in this preferred embodiment, for example; therefore the N-type transistor 204 is also turned on. The storage capacitor 231 is thus charged with the storage voltage $V_a$ during this period. When the scanning signal Scan switches off (being high level voltage in this preferred embodiment, for example), the transistor 203 is turned off. Since the complementary-scanning signal XScan is inverse of the scanning signal Scan, the transistor 204 is also turned off. The storage capacitor 231 provides the storage voltage $V_a$ during this period so that a constant current is sustained between a source and a drain of the current limiting transistor 202, so that the OLED is illuminated.

Figure 2B:
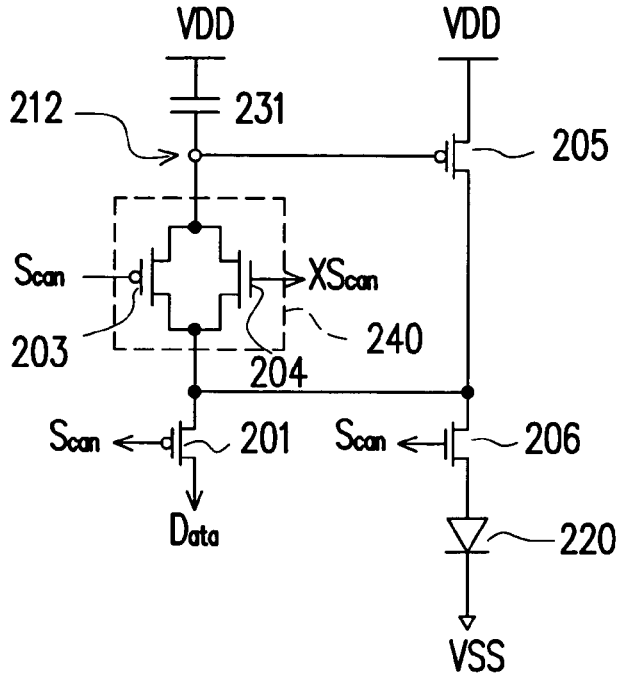
FIG. 2B is a pixel circuit diagram illustrating an OLED display panel according to one preferred embodiment of the present invention.
Figure 2C:
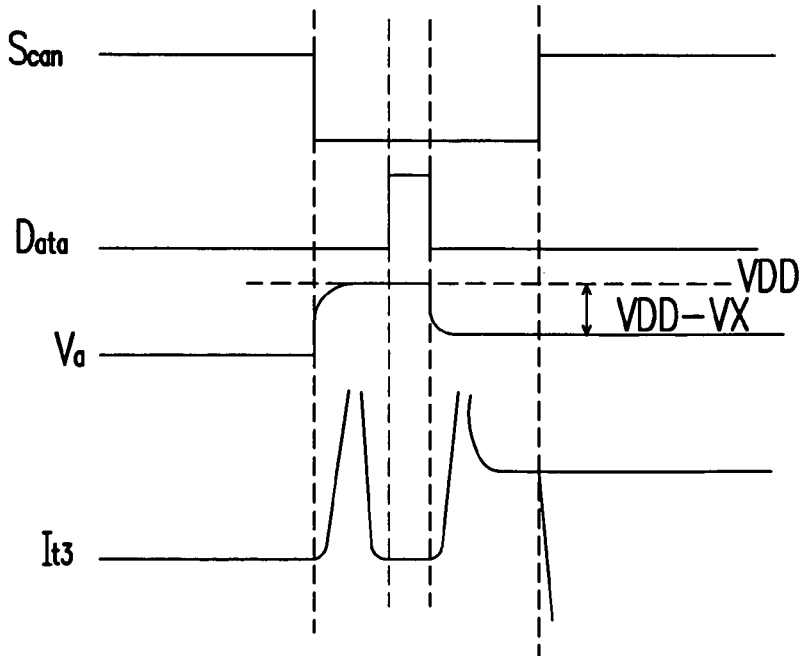
FIG. 2C is a timing diagram of voltage or current signals of the OLED display shown in FIG. 2B.

The difference between the application in this present invention as opposed to the prior art is described with reference to another embodiment hereinafter. Referring to FIG. 2B, a pixel circuit for driving an OLED display according to another embodiment of the present invention is illustrated. FIG. 2C illustrates timing diagrams of the signals of the pixel circuit shown in FIG. 2B. Referring to both FIGS. 2B and 2C, the circuit comprises two complementary transistors 203 and 204, which are similar to the aforementioned P-type transistor 203 and the N-type transistor 204 constructing the transmission gate 240, and therefore detailed description thereof are not repeated hereinafter. When the scanning signal Scan switches on (low level voltage in this embodiment, for example), both the P-type transistor 203 and the P-type transistor 201 are turned on, and the N-type transistor 206 is turned off. The complementary-scanning signal XScan is inverse of the scanning signal Scan in this embodiment, for example; thus the N-type transistor 204 is also turned on. The storage voltage $V_a$ is hence equal to $V_x$ subtracted from the system voltage VDD, wherein $V_x$ is the voltage difference between the source and the gate of the current limiting transistor 205. The storage capacitor 231 is charged to a storage voltage $V_a$ during this period. Therefore, a current flowing from system voltage VDD via the current limiting transistor 205 and the transistor 201 to the data current source Data is $I_{data}=k(V_x-V_{th})^2$, wherein $k=\mu C_{ox}(W_{205}/L_{205})$, $W_{205}$ and $L_{205}$ are channel width and channel length of the current limiting transistor, respectively.

When the scanning signal Scan switches off (high level voltage in this preferred embodiment, for example), the transistor 203 and the transistor 201 are both turned off, whereas the transistor 206 is turned on. Since the complementary-scanning signal XScan is inverse of the scanning signal Scan, the transistor 204 is also turned off. The storage capacitor 231 provides a storing voltage $V_a$ so that the current flowing between the drain and the source of the transistor 205 is kept constant, which will in turn correspondingly render the luminance of the OLED diode uniform. When feed-through effect occurs, the transistor 203 changes the storing voltage $V_a$ by $\Delta V_{203}$ at node a during switching of the scanning signal Scan, whereas the transistor 204 changes the storing voltage $V_a$ by $\Delta V_{204}$ at node a. In this embodiment, transistors 203 and 204 are complementary, for example, thus $\Delta V=\Delta V_{203}+\Delta V_{204}=0$, and therefore the drawbacks of the prior art can be effectively resolved.

Figure 3:
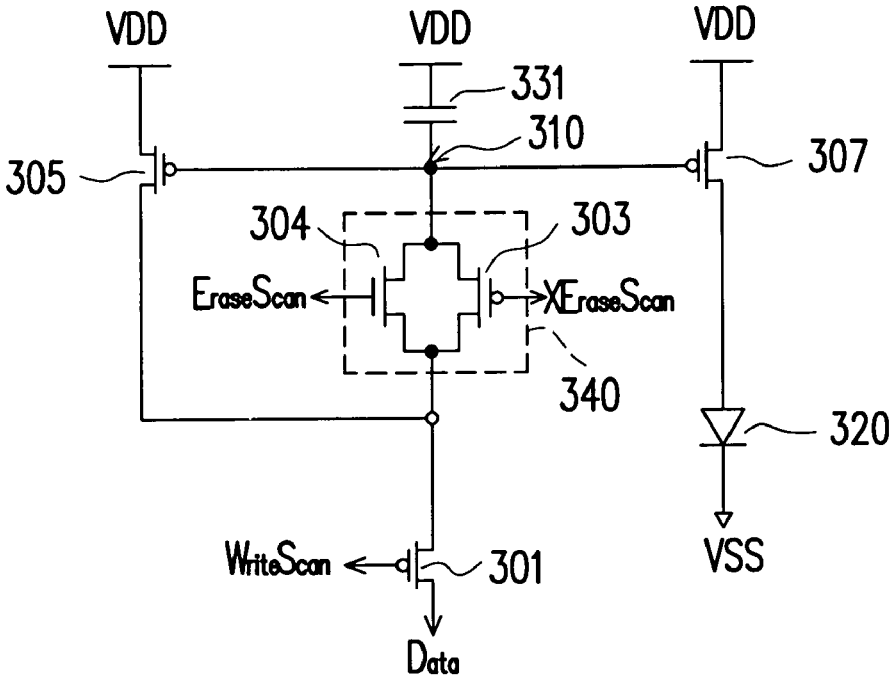
FIG. 3 is a view of a circuit diagram of an OLED display panel according to one preferred embodiment of the present invention.

It is to be noted that the circuit for the current-driven flat panel display need not be embodied according aforementioned embodiments described with reference to FIGS. 2A or 2B to achieve the purpose of the present invention. The circuit for driving the flat display panel can also be configured according to another embodiment of the present invention described hereinafter. Referring to FIG. 3, shows a circuit diagram of a circuit for driving an OLED display according to yet another embodiment of the present invention is illustrated. As shown in FIG. 3, the storage capacitor 331 is coupled to the system voltage VDD via one terminal, and the other terminal of the capacitor 331 is coupled to the storage voltage $V_a$. The configuration of the P-type transistor 303 and the N-type transistor 304 of the transmission gate 340 are similar to the previous embodiments, and therefore detailed description thereof are not repeated hereinafter. One input/output terminal of the transmission gate 340 is coupled to the storage voltage $V_a$, and the other input/output terminal of the transmission gate 340 is coupled to a source of the transistor 301 and a gate of the transistor 305. A gate of the transistor 304 is coupled to a clearing signal EraseScan, whereas a gate of the transistor 303 is coupled to a complementary clearing signal XEraseScan, wherein the complementary clearing signal XEraseScan is inverse of the clearing signal EraseScan in this embodiment, for example. A source of the transistor 305 is coupled to the system voltage VDD, and a gate is coupled to the storage voltage $V_a$. A drain of the transistor 301 is coupled to the data current source Data; a gate is coupled to a loading signal WriteScan. A gate of the current limiting transistor 307 is coupled to the storing voltage $V_a$ so as to control the flow of current through the source and the drain thereof, wherein the source is coupled to the system VDD and the drain of the current limiting transistor is coupled to the anode of the OLED diode. The cathode of the OLED diode is coupled to a specific voltage level (ground voltage in this embodiment, for example).

Figure 4:
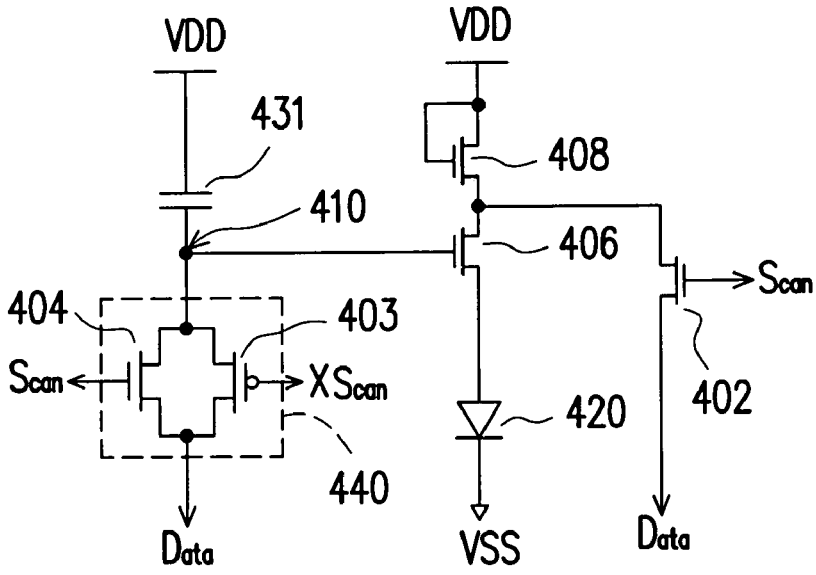
FIG. 4 is a view of a circuit diagram of an OLED display panel according to another embodiment of the present invention.

Yet another embodiment of a circuit for driving an OLED display according to the present invention is described with reference to FIG. 4. Referring to FIG. 4, another circuit diagram of a circuit for driving the OLED display is illustrated. As shown in FIG. 4, the storage capacitor 431 is coupled to the system voltage VDD via one terminal, and the other terminal of the capacitor 431 is coupled to a storing voltage $V_a$. The configuration of the P-type transistor 403 and the N-type transistor 404 of the transmission gate 440 are similar to previous preferred embodiments, and therefore will not be repeated hereinafter. One input/output terminal of the transmission gate 440 is coupled to the storage voltage $V_a$, and the other input/output terminal of the transmission gate 440 is coupled to the data current source Data. A gate of the transistor 404 of the transmission gate 440 is coupled to the scanning signal Scan, a gate of the transistor 403 is coupled to the complementary scanning signal XScan, which is inverse of the scanning signal Scan in this embodiment of the present invention. A drain and a gate of the transistor 408 are both coupled to the system voltage VDD, whereas a source of the transistor 408 is coupled to a drain of the transistor 402 and a drain of the current limiting transistor 406. A source of the transistor 402 is coupled to the data current source Data, and a gate is coupled to the scanning signal Scan. A gate of the current limiting transistor is coupled to the storing voltage $V_a$, and a source is coupled to the anode of the OLED diode. The cathode of the OLDE diode is coupled to a specific voltage level (ground voltage in this embodiment, for example).

Figure 5:
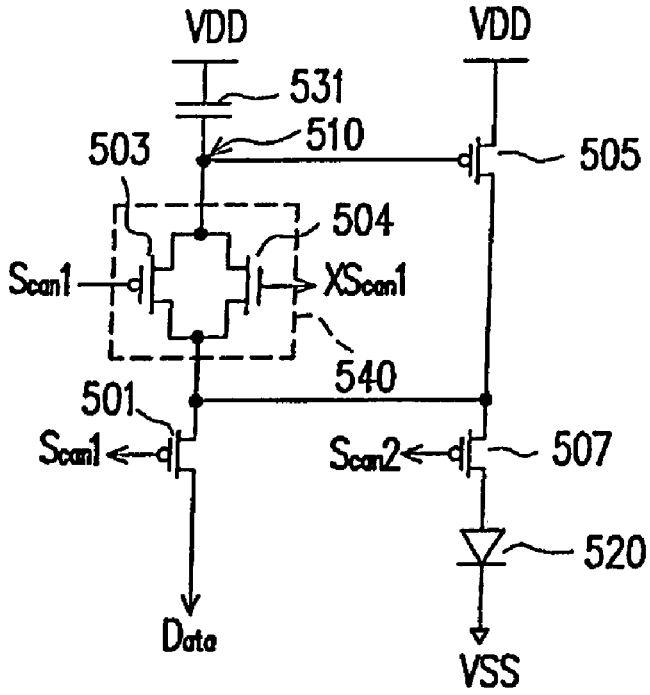
FIG. 5 is a view of a circuit diagram of an OLED display panel according to yet another embodiment of the present invention.

A circuit for driving an OLED display according to yet another embodiment of the present invention is described with reference to FIG. 5. As shown in FIG. 5, the circuit diagram is similar to that of FIG. 2B. The circuit comprises a first scanning signal Scan1 corresponding to the scanning signal Scan of the previous embodiment, and a gate of the transistor 507 is coupled to a second scanning signal Scan2. With this setup, the OLED is illuminated during charging period of the storage capacitor 531.

Figure 6:
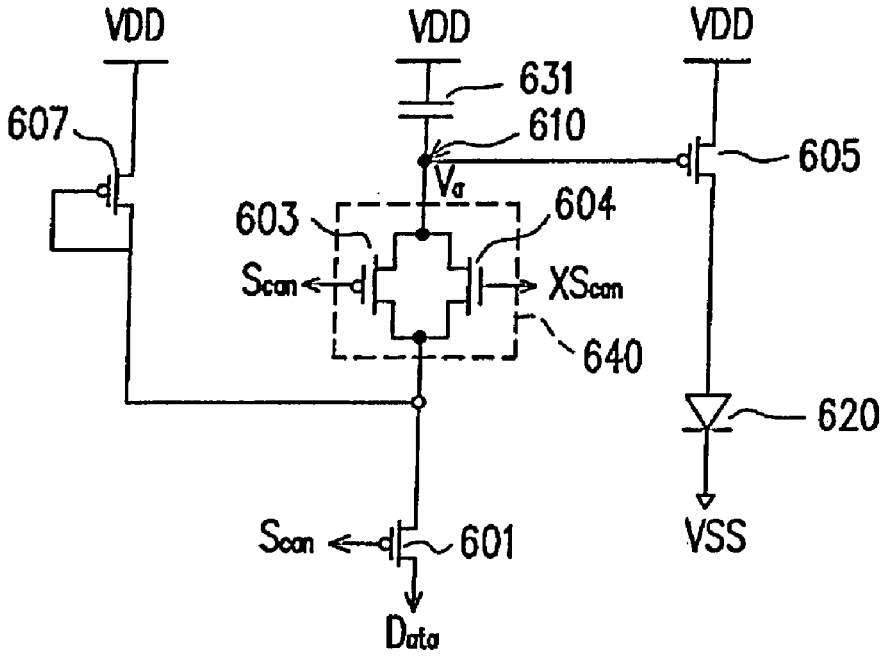
FIG. 6 is a view of a circuit diagram of an OLED display panel according to yet another embodiment of the present invention.

Referring to FIG. 6, a diagram of a circuit for driving an OLED display according to yet another preferred embodiment of the present invention is illustrated. As shown in FIG. 6, the storage capacitor 631 is coupled to the system voltage VDD via one terminal, and the other terminal of the storage capacitor 631 is coupled to the storage voltage $V_a$. The configuration of the P-type transistor 603 and the N-type transistor 604 of the transmission gate 640 are similar to those described in the previous embodiments, and there not repeated hereinafter. One input/output terminal of the transmission gate 640 is coupled to the storage voltage $V_a$, and the other input/output of the transmission gate 640 is coupled to a source of the transistor 601, and a drain and a gate of the transistor 607. A gate of the transistor 603 in the transmission gate 640 is coupled to the scanning signal Scan, a gate of the transistor 604 of the transmission gate 640 is coupled to the complementary scanning signal XScan, which is inverse of the scanning signal Scan in this embodiment, for example. A source of the transistor 607 is coupled to the system voltage VDD. A drain of the transistor 601 is coupled to the data current source Data, and a gate is coupled to the scanning signal Scan. A gate of the current limiting transistor 605 is coupled to the storage voltage $V_a$, a source is coupled to the system voltage VDD, and a drain is coupled to the anode of the OLED diode. The cathode of the OLED is coupled to a specific voltage level VSS (ground voltage in this embodiment, for example).

Figure 7:
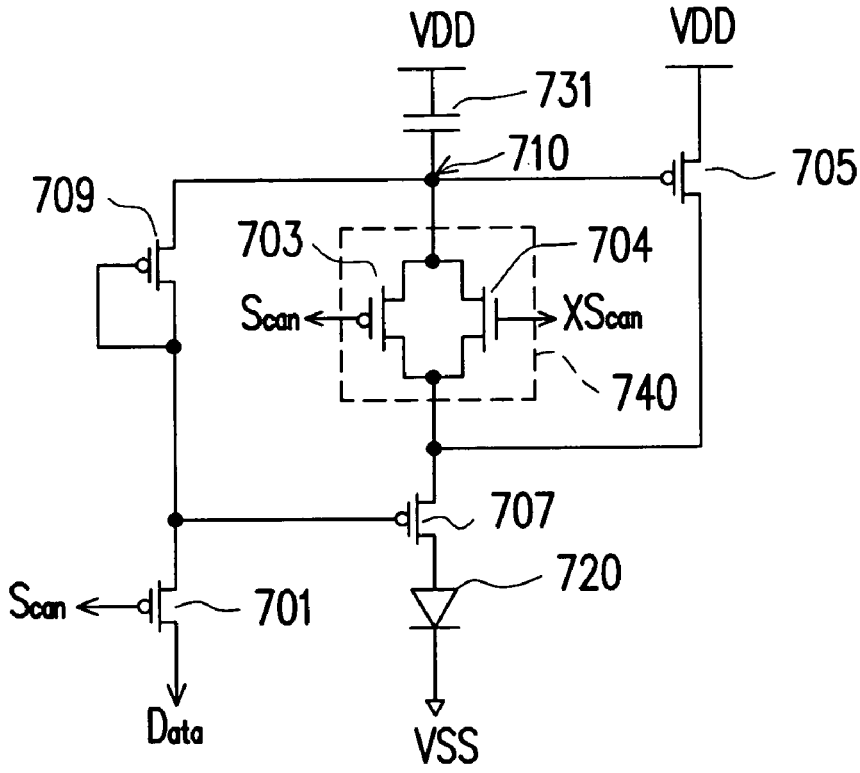
FIG. 7 is a view of a circuit diagram of an OLED display panel according to yet another embodiment of the present invention.

Referring to FIG. 7, a circuit diagram of a circuit for driving an OLED display according to yet another preferred embodiment of the present invention is illustrated. As shown in FIG. 7, the storage capacitor 731 is coupled to the system voltage VDD via one terminal, and the other terminal of the storage capacitor 731 is coupled to the storage voltage $V_a$. The configuration of the P-type transistor 703 and the N-type transistor 704 in the transmission gate 740 are similar to those described in the previous preferred embodiments, and therefore detailed description thereof is not repeated hereinafter. One input/output terminal of the transmission gate 740 is coupled to the storing voltage $V_a$, and the other input/output terminal is coupled to a source of the transistor 707 and a drain of the current limiting transistor 705. A gate of the transistor 703 of the transmission gate 740 is coupled to the scanning signal Scan, and a gate of the transistor 704 is coupled to the complementary scanning signal XScan, which is inverse of the scanning signal in this embodiment, for example. A gate of the current limiting transistor 705 is coupled to the storage voltage $V_a$, and a source is coupled to the system voltage VDD. A gate of the transistor 707 is coupled to a source of the transistor 701, a drain of the transistor 709 and a gate of the transistor 709. A source of the transistor 709 is coupled to the storing voltage $V_a$, and a drain of the transistor 707 is coupled to the anode of the OLED diode. The cathode of the OLED diode is coupled to a specific voltage level VSS (ground voltage in this embodiment, for example). A drain of the transistor 701 is coupled to the data current source Data, whereas a gate is coupled to the scanning signal Scan.

The above description provides a full and complete description of the preferred embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

What is claimed is:

1. A circuit, for driving a flat panel display, for receiving a data of a current source, a first signal and a second signal and outputting a current via a current output terminal, the circuit comprises:

a storage capacitor, having a first terminal and a second terminal, the first terminal being coupled to a system voltage, the second terminal being coupled to a storage voltage;

a transmission gate, comprising a first N-type transistor and a first P-type transistor, a first source/drain terminal of the first N-type transistor being coupled to a first source/drain terminal of the first P-type transistor serving as a first input/output terminal of the transmission gate, a second source/drain terminal of the first N-type transistor being coupled to a second source/drain terminal of the first P-type transistor serving as a second input/output terminal of the transmission gate, a gate terminal of the first N-type transistor being a first gate terminal of the transmission gate, a gate terminal of the first P-type transistor being a second gate terminal of the transmission gate, the first input/output terminal of the transmission gate being coupled to the storage voltage, the second input/output terminal of the transmission gate being coupled to the data current source, the first gate terminal of the transmission gate being coupled to the first signal, the second gate terminal of the transmission gate being coupled to the second signal; and a current-limiting transistor, wherein a gate terminal of the current-limiting transistor is coupled to the storage voltage, a first source/drain terminal of the current-limiting transistor is coupled to the system voltage, a second source/drain terminal of the current-limiting transistor is coupled to the current output terminal for determining current flow from the current-limiting transistor according to the storage voltage.

2. The circuit as recited in claim 1, further comprising:

a second P-type transistor, for coupling the transmission gate to the data of the current source, a gate terminal of the second P-type transistor being coupled to the second signal; and a second N-type transistor, for coupling the current-limiting transistor to the current output terminal, a gate terminal of the second N-type transistor being coupled to the second signal, wherein a terminal coupling the second N-type transistor and the limiting transistor is further coupled to the second input/output terminal of the transmission gate.

3. The circuit as recited in claim 1, further comprising:

a second N-type transistor, coupling the transmission gate and the data of the current source, a gate terminal of the second N-type transistor being coupled to a third signal; and a second P-type transistor, a first source/drain terminal of the second P-type transistor being coupled to the system voltage, a second source/drain terminal of the second P-type transistor being coupled to the second input/output terminal of the transmission gate, a gate terminal of the second P-type transistor being coupled to the storage voltage.

4. The circuit as recited in claim 1, further comprising:

a second N-type transistor, for coupling the system voltage to the current limiting transistor, a gate terminal of the second N-type transistor being coupled to the system voltage; and a third N-type transistor, a first source/drain terminal of the third P-type transistor being coupled to a first source/drain terminal of the current limiting transistor, a second source/drain terminal of the third P-type transistor being coupled to the data current source, a gate terminal of the third P-type transistor being coupled to the first signal.

5. The circuit as recited in claim 1, further comprising:

a second P-type transistor, for coupling the transmission gate and the data current source, a gate terminal of the second P-type transistor being coupled to the second signal; and a third P-type transistor, for coupling the current limiting transistor to the current output terminal, a gate terminal of the third P-type transistor being coupled to a third signal, wherein a terminal is coupled to the third P-type transistor and the current-limiting transistor is coupled to the second input/output transmission gate.

6. The circuit as recited in claim 1, further comprising:

a second P-type transistor, for coupling the transmission gate to the data current source, a gate terminal of the second P-type transistor being coupled to the second signal; and a third P-type transistor, wherein a first source/drain of the third P-type transistor is coupled to the system voltage, a second source/drain and a gate of the third P-type transistor are coupled to the second input/output terminal of the transmission gate.

7. The circuit as recited in claim 1, wherein the first signal is inverse of the second signal.

8. The circuit as recited in claim 1, wherein the flat panel display is an Organic Luminescence Emitting Display (OLED).

9. A circuit for driving a flat-panel display, for receiving a data of the current source, a first signal and a second signal and outputting a current via a current output terminal, the circuit comprising:

a storage capacitor, having a first terminal and a second terminal, the first terminal being coupled to a system voltage, the second terminal being coupled to a storage voltage;

a transmission gate, comprising a N-type transistor and a first P-type transistor, a first source/drain terminal of the N-type transistor being coupled to a first source/drain terminal of the first P-type transistor serving as a first input/output terminal of the transmission gate, a second source/drain terminal of the N-type transistor being coupling to the second source/drain terminal of the first P-type transistor serving as a second input/terminal of the transmission gate, a gate terminal of the N-type transistor being a first gate terminal of the transmission gate, a gate of the first P-type transistor being a second gate terminal of the transmission gate, the first input/output terminal of the transmission gate being coupled to the storage voltage, the first gate terminal of the transmission gate being coupled to the first signal, the second gate terminal of the transmission gate being coupled to the second signal;

a current-limiting transistor, wherein a gate terminal of the current-limiting transistor is coupled to the storage voltage, a first source/drain terminal of the current-limiting transistor is coupled to the system voltage for determining a current density flowing from the current-limiting transistor according to the storage voltage;

a second P-type transistor, wherein a first source/drain terminal of the second P-type transistor is coupled to the second input/output terminal of the transmission gate and a second source/drain terminal of the current-limiting transistor, a second source/drain terminal of the second P-type transistor is coupled to the current output terminal;

a third P-type transistor, wherein a first source/drain terminal of the third P-type transistor is coupled to the storage voltage, and a second source/drain terminal and a gate terminal of the third P-type transistor are coupled to a gate of the second P-type transistor; and a fourth P-type transistor, wherein a first source/drain terminal of the fourth P-type transistor is coupled to a gate of the third P-type transistor, a second source/drain terminal of the fourth P-type transistor is coupled to the data current source, and a gate of the fourth P-type transistor is coupled to the second signal.

10. The circuit as recited in claim 9, wherein the first signal is inverse of the second signal.

11. The circuit as recited in claim 9, wherein the flat panel display is an Organic Luminescence Emitting Display (OLED).

* * * * *